US005498468A

United States Patent [19]

Blaney

[11] Patent Number: 5,498,468

[45] Date of Patent: Mar. 12, 1996

[54] FABRICS COMPOSED OF RIBBON-LIKE FIBROUS MATERIAL AND METHOD TO MAKE THE SAME

[75] Inventor: Carol A. Blaney, Roswell, Ga.

[73] Assignee: Kimberly-Clark Corporation, Neenah, Wis.

[21] Appl. No.: 311,664

[22] Filed: Sep. 23, 1994

[51] Int. Cl.[6] ..... B32B 27/14

[52] U.S. Cl. ..... 428/198; 156/167; 156/290; 156/308.2; 264/175; 428/283; 428/288; 428/225; 428/229; 428/253; 428/296; 428/152; 428/373; 428/397; 428/400

[58] Field of Search ..... 428/198, 283, 428/288, 373, 152, 296, 229, 225, 253, 224, 397, 400; 264/175; 156/167, 290, 308.2

[56] References Cited

U.S. PATENT DOCUMENTS

| | | | |
|---|---|---|---|
| 3,463,652 | 8/1969 | Whitesel et al. | 117/7 |
| 3,549,467 | 12/1970 | Keuchel et al. | 161/65 |
| 3,549,470 | 12/1970 | Greenwald et al. | 161/70 |
| 3,576,931 | 4/1971 | Chopra et al. | 264/51 |
| 3,884,030 | 5/1975 | Baxter et al. | 57/140 |
| 3,969,471 | 7/1976 | Driscoll | 264/50 |
| 3,969,472 | 7/1976 | Driscoll | 264/50 |
| 4,028,452 | 6/1977 | Driscoll | 264/51 |
| 4,062,915 | 12/1977 | Stricarczuk et al. | 264/50 |
| 4,085,175 | 4/1978 | Keuchel | 264/51 |
| 4,176,978 | 12/1979 | Ruzicka et al. | 401/96 |
| 4,180,536 | 12/1979 | Howell, Jr. et al. | 264/53 |
| 4,188,448 | 2/1980 | Stricharczuk et al. | 428/311 |
| 4,264,670 | 4/1981 | Kontos | 428/224 |
| 4,279,848 | 7/1981 | Baxter et al. | 264/53 |
| 4,282,890 | 8/1981 | Howell, Jr. et al. | 131/332 |
| 4,483,897 | 11/1984 | Fujimura et al. | 428/288 |
| 4,485,141 | 11/1984 | Fujimura et al. | 428/288 |
| 4,562,022 | 12/1985 | Li et al. | 264/54 |
| 4,626,390 | 12/1986 | Li et al. | 264/46.1 |
| 4,728,472 | 3/1988 | Windley | 264/53 |
| 4,753,762 | 6/1988 | Li et al. | 264/54 |
| 4,858,629 | 8/1989 | Cundari | 131/332 |
| 5,124,098 | 6/1992 | Vischer | 264/54 |
| 5,368,925 | 11/1994 | Hosokawa et al. | 428/378 |

FOREIGN PATENT DOCUMENTS

| | | |
|---|---|---|
| 0338854A | 10/1989 | European Pat. Off. . |
| 2148588A | 5/1973 | Germany . |
| 68-027551B | 5/1968 | Japan . |
| 43-022332B | 8/1968 | Japan . |
| 70-018727B | 3/1970 | Japan . |
| 48-063025A | 9/1973 | Japan . |
| 49-014730A | 2/1974 | Japan . |
| 49-061414A | 6/1974 | Japan . |
| 50-077616A | 6/1975 | Japan . |
| 55-040682B | 10/1980 | Japan . |
| 6903634A | 9/1970 | Netherlands . |
| 7212859A | 6/1972 | Netherlands . |
| 1318964 | 5/1973 | United Kingdom . |

*Primary Examiner*—James J. Bell
*Attorney, Agent, or Firm*—Karl V. Sidor

[57] ABSTRACT

A method of making a flexible fabric composed of a fibrous matrix of ribbon-like, conjugate, spun filaments. The method includes the following steps: 1) providing a fibrous matrix composed of individual, spun filaments bonded at spaced-apart bond locations, the filaments themselves being composed of: (i) a core formed of at least one low-softening point thermoplastic component; and (ii) a sheath formed of at least one high-softening point component; and 2) applying a flattening force to the fibrous matrix to durably distort the core of individual filaments into a ribbon-like configuration having a width greater than its height so that: (i) the individual filaments are substantially unattached between the spaced-apart bond locations, and (ii) the width of individual filaments is oriented substantially in the planar dimension of the fabric. Also disclosed is a flexible fabric composed of a fibrous matrix of ribbon-like, conjugate, spun filaments joined at spaced apart bond locations.

56 Claims, 3 Drawing Sheets

FABRICS COMPOSED OF RIBBON-LIKE FIBROUS MATERIAL AND METHOD TO MAKE THE SAME

FIELD OF THE INVENTION

The present invention relates to conjugate fibrous material, fabrics formed from such materials, and methods of making the same.

BACKGROUND OF THE INVENTION

It is generally understood to be both economically and environmentally desirable to minimize the amount of raw material contained in thermoplastic spun filaments that make up a variety of fabrics. Generally speaking, less raw material results in lower basis weight webs that cost less and conserve resources.

One problem associated with many conventional woven and nonwoven fabrics is that it is difficult to maximize the ability of a fabric to cover or serve as a barrier or shield while maintaining desirable breathability or permeability. For example, it is desirable for gases and/or vapors (e.g., water vapor) to pass freely or diffuse through a fabric even though the same fabric functions to substantially bar or shield liquids (e.g., liquid droplets) and/or electromagnetic radiation (e.g., visible or ultraviolet light) from an object covered by the fabric.

An equally significant problem is that many fabrics made from spun filaments and/or fibers have unsatisfactory tactile properties. As an example, fabrics containing substantial amounts of filaments and/or fibers that are conventionally melt-spun from economical, recyclable polymers such as, for example, polypropylene, polyethylene and the like, often can have smooth, untextured surfaces and/or relatively large diameters. These filaments and/or fibers can have a "waxy" or slick feel that may be perceived as undesirable. Many applications of such fabrics are thwarted by their inability to be perceived as relatively "cloth-like" (e.g., not slick or "waxy" in a tactile sense).

Fabrics made of filaments and/or fibers composed of a single material or blends of materials (e.g., substantially mono-component filaments and/or fibers) have been subjected to hot calendaring to improve the fabrics' covering or barrier properties. Unfortunately, the resulting fabrics have been characterized as "paper-like" (i.e., stiff and "noisy" or producing sounds when flexed). Such fabrics have exhibited poor drape, flexibility and even breathability. This is generally attributed to individual components of the fabric (e.g., filaments and/or fibers) melting, bonding and/or fusing together during the hot calendaring operation.

Attempts have been made to reduce the slick or "waxy" feel of some filaments and/or fibers by incorporating an expanding agent into the entire filament/fiber or into the sheath of a sheath-and-core conjugate filament and/or fiber. Such materials have been converted into fabrics intended to have "cloth-like" tactile properties. However, these materials fail to address the important problems of reducing the basis weights of the webs and improving the covering or shielding ability of the fabrics.

While these attempts may be of interest to those engaged in the manufacture of fabrics and/or filament (i.e., filaments and/or fibers) they do not address the need to minimize the amount of raw material contained in thermoplastic spun filaments that make up a variety of fabrics while achieving a satisfactory level of fabric softness, drape and flexibility.

For example, there is a need for a fabric that can be manufactured from an inexpensive raw material (e.g., polypropylene, polyethylene and the like) than can satisfy these requirements. A need also exists for a fabric that minimizes the amount of raw material contained in fabric while achieving a satisfactory level of fabric softness, drape and flexibility as well as an acceptable level of cover and/or shielding from liquids and/or electromagnetic radiation (e.g., visible and ultraviolet light). Additionally, a need exists for a fabric formed from an relatively inexpensive raw material that meets these requirements and also has "cloth-like" tactile properties and/or which provides acceptable levels of permeability or breathability. Furthermore, there is a need for a practical process for producing such a material that is relatively simple and can be adapted to modern high-speed manufacturing processes.

Meeting these needs is important since it is both economically and environmentally desirable to reduce the amount of raw material used in fabrics and/or filaments/fibers and still provide a fabric having enhanced covering, barrier and/or shielding properties. It is also both economically and environmentally desirable to produce such a fabric while also providing satisfactory levels of permeability, breathability, flexibility and/or drape.

DEFINITIONS

As used herein, the term "spunbond web" refers to a web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown fibers" means fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved Device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "microfibers" means small diameter fibers having an average diameter not greater than about 100 microns (μm), for example, having a diameter of from about 0.5 microns to about 50 microns, more specifically microfibers may also have an average diameter of from about 1 micron to about 20 microns. Microfibers having an average diameter of about 3 microns or less are commonly referred to as ultra-fine microfibers. A description of an exemplary process of making ultra-fine microfibers may be found in, for example, U.S. Pat. Nos. 5,213,881 and 5,271,883, entitled "A Nonwoven Web With Improved Barrier Properties", incorporated herein by reference in their entirety.

As used herein, the term "thermoplastic material" refers to a polymer that softens when exposed to heat and returns to a relatively hardened condition when cooled to room temperature. Natural substances which exhibit this behavior are crude rubber and a number of waxes. Other exemplary thermoplastic materials include, without limitation, polyvinyl chloride, polyesters, nylons, polyfluorocarbons, polyethylene (including linear low density polyethylene), polyurethane, polystyrene, polypropylene, polyvinyl alcohol, caprolactams, and cellulosic and acrylic resins.

As used herein, the term "fabric" refers to a material that may be either a woven material, a knit material, a nonwoven material or combinations thereof.

As used herein, the terms "nonwoven fabric" and "nonwoven web" refer to a fabric or web that has a structure of individual fibers or filaments which are interlaid, but not in an identifiable repeating manner. Nonwoven webs have been, in the past, formed by a variety of processes known to those skilled in the art such as, for example, meltblowing, spunbonding and bonded carded web processes.

As used herein, the term "conjugate spun filaments" refers to filaments and/or fibers composed of a core portion substantially or completely enveloped by a sheath. Generally speaking, the core portion and the sheath portion are formed of different polymers and spun using processes such as, for example, melt-spinning processes.

As used herein, the term "softening point" refers to a temperature near the melt transition of a generally thermoplastic polymer. The softening point occurs at a temperature below the melt transition and corresponds to a magnitude of phase change and/or change in polymer structure sufficient to permit relatively durable deformation of the polymer using relatively low levels of force (i.e., relative to temperatures below the softening point). Generally speaking, internal molecular arrangements in a polymer tend to be relatively fixed at temperatures below the softening point. Under such conditions, many polymers are difficult to durably distort or reshape although a few polymers such as, for example, certain elastomeric polymers may be temporarily (but not durably) distorted (e.g., stretched, dented, bounced, and the like). At about the softening point, the polymer's ability to flow is enhanced so that it can be durably distorted. Generally speaking, the softening point of a polymer is at or about the Vicat Softening Temperature as determined essentially in accordance with ASTM D 1525-91. That is, the softening point is generally less than about the polymer's melt transition and generally about or greater than the polymer's Vicat Softening Temperature.

As used herein, the term "low-softening point component" refers to one or more thermoplastic polymers composing an element of a conjugate spun filament (i.e., a sheath or a core) that has a lower softening point than the one or more polymers composing at least one different element of the same conjugate spun filament (i.e., high-softening point component) so that the low-softening point component may be substantially malleable or easily distorted when at or about its softening point while the one or more polymers composing the at least one different element of the same conjugate spun filament remains relatively difficult to durably distort or reshape at the same conditions. For example, the low-softening point component may have a softening point that is at least about 50° C. lower than the high-softening point component.

As used herein, the term "high-softening point component" refers to one or more polymers composing an element of a conjugate spun filament (i.e., a sheath or a core) that has a higher softening point than the one or more polymers composing at least one different element of the same conjugate spun filament (i.e., low-softening point component) so that the high-softening point component remains relatively undistortable or unshapeable when it is at a temperature under which the one or more polymers composing at least one different element of the same conjugate spun filament (i.e., the low-softening point component) are substantially malleable (i.e., at about their softening point). For example, the high-softening point component may have a softening point that is at least about 50° C. higher than the low-softening point component.

As used herein, the term "durably distort" refers to an enduring, long-lasting or essentially permanent deformation of a pliable material, such as, for example, a thermoplastic polymer that has been heated to a readily malleable, shapeable and deformable state. As an example, applying a sufficient flattening force to a thermoplastic polymer filament/fiber that has been heated to about the polymer's softening point and which has a generally circular cross-section will durably distort the filament/fiber into a flattened configuration, especially if the filament/fiber is allowed to cool in the flattened configuration. If generally the same flattening force is applied to the filament/fiber at a much lower temperature (e.g., room temperature), the filament/fiber may distort but would generally regain at least some or much of its original circular-cross sectional configuration after removal of the flattening force.

As used herein, the terms "cover", "coverage" or "surface area coverage" refer to the percent closed area of a fabric as determined using conventional analytical image analysis techniques. Generally speaking, the percent closed area is expressed as 100—(percent open area). The percent open area is measured from an image of the sample generated so that is has a high level of contrast between the open and closed areas. Generating such an image will depend upon variables such as, for example, the light source and placement, basis weight and/or texture of the sample. The threshold of a conventional image analyzer is typically adjusted to half-black and the percent open area is determined. The generated image may be processed using equipment such as a Cambridge Quantimet-10 image analyzer available from Leica, Inc. of Deerfield, Ill.

As used herein, the term "consisting essentially of" does not exclude the presence of additional materials which do not significantly affect the desired characteristics of a given composition or product. Exemplary materials of this sort would include, without limitation, pigments, functionalizing additives, fillers, antioxidants, stabilizers, surfactants, waxes, flow promoters, particulates or materials added to enhance processability or properties of a composition.

SUMMARY OF THE INVENTION

The present invention responds to the needs described above by providing a method of making a flexible fabric composed of a fibrous matrix of ribbon-like, conjugate, spun filaments. The method includes the following steps: 1) providing a fibrous matrix composed of individual, spun filaments bonded at spaced-apart bond locations, the filaments themselves being composed of: (i) a core formed of at least one low-melting point thermoplastic component; and (ii) a sheath formed of at least one high-softening point component; and 2) applying a flattening force to the fibrous matrix to durably distort the core of individual filaments into a ribbon-like configuration having a width greater than its height so that: (i) the individual filaments are substantially unattached between the spaced-apart bond locations, and (ii) the width of individual filaments is oriented substantially in the planar dimension of the fabric.

According to the method of the present invention, the fibrous matrix is generally at a temperature near the softening point of the low-melting point thermoplastic component during application of the flattening force so that the low-melting point thermoplastic component is malleable (i.e., able to be durably distorted by application of the flattening force). The flattening force is applied by a calendar roll arrangement (e.g., pressure roll arrangement). Desirably, the calendar roll arrangement is a heated calendar roll arrangement (e.g., heated pressure roll arrangement).

In one aspect of the invention, a substantial portion of the low-softening point thermoplastic component in the core may have a softening point that is at least about 50° C. lower than the softening point of the high-softening point component in the sheath. For example, the low-softening point thermoplastic component in the core may have a softening point that is at least about 70° C. lower than the softening point of the high-softening point component in the sheath.

In an embodiment of the method of the invention, the fibrous matrix may be mechanically softened after the flattening force is applied. Mechanical softening may be carried out using techniques including, but not limited to, intermeshed grooved rolls, intermeshed patterned rolls, liquid jets and gas jets. The liquid jets may be high-pressure jets of water. The gas jets may be high-pressure jets of air.

According to the method of the present invention, the flattening force may be used to durably distort individual filaments to a width to height ratio of greater than about 2:1. For example, the individual filaments may be durably distorted to a width to height ratio of greater than about 3:1.

The present invention encompasses a flexible fabric composed of a fibrous matrix of ribbon-like, conjugate, spun filaments joined at spaced apart bond locations. The filaments themselves are composed of: 1) a ribbon-like core having a width greater than its height formed of at least one low-softening point thermoplastic component; and 2) a sheath formed of at least one high-softening point component, the sheath substantially enveloping the core; so that individual filaments are: (i) substantially unattached between the spaced-apart bond locations, and (ii) oriented so their widths are substantially in the planar dimension of the fabric.

Generally speaking, the conjugate filaments may contain from about 1 to about 50 percent, by weight, of the high-softening point component and from about 50 to about 99 percent, by weight, of the low-softening point thermoplastic component. For example, the conjugate filaments may contain from about 1 to about 30 percent, by weight, of the high-softening point component and from about 70 to about 99 percent, by weight, of the low-softening point thermoplastic component. As another example, the conjugate filaments may contain from about 5 to about 30 percent, by weight, of the high-softening point component and from about 70 to about 95 percent, by weight, of the low-softening point thermoplastic component. The high-softening point component may be, for example, polyesters, polyamides and/or high-softening point polyolefins. The low-softening point thermoplastic component may be, for example, low-softening point polyolefins, low-softening point elastomeric block copolymers, and blends of the same.

The flexible fabric may further include one or more secondary material, such as, for example, fibers and/or particulates that are incorporated into the fibrous matrix.

In an aspect of the present invention, the sheath component of individual filaments may include a distribution of rugosities (bumps, fissures, microfibrils, cavities, etc.) across at least a portion of the surface of the sheath. In another aspect of the invention, the sheath may include multiple lobes across at least a portion of the surface of the sheath. In yet another aspect of the invention, the sheath may include both multiple lobes and a distribution of rugosities (bumps, microfibril, cavities, etc.) across at least a portion of the surface of the sheath (e,g,. the lobes).

In one embodiment of the invention, the flexible fabric may provide a surface area coverage at least about 10 percent greater than an identical untreated fabric (i.e., not subjected to the method of the present invention) of filaments having a substantially circular cross-section. For example, the flexible fabric may provide a surface area coverage at least about 50 percent greater than an identical untreated fabric of filaments having a substantially circular cross-section. As another example, the flexible fabric may provide a surface area coverage at least about 100 percent greater than an identical untreated fabric of filaments having a substantially circular cross-section. As yet another example, the flexible fabric may provide a surface area coverage at least about 300 percent greater than an identical untreated fabric of filaments having a substantially circular cross-section.

The fibrous matrix may be, for example, one or more woven fabrics, knit fabrics and/or nonwoven fabrics. These fabrics may be used alone or in combination. Desirably, the fibrous matrix is a nonwoven web of conjugate, spunbond filaments.

In an aspect of the present invention, the ribbon-like, conjugate, spun filaments may incorporate substances that reflect ultra-violet wavelength radiation, absorb ultra-violet wavelength radiation, retard or inhibit photodegradation, absorb moisture, adsorb odors, and/or are anti-microbial.

The present invention also encompasses a method of making ribbon-like, conjugate, spun filaments. The method includes the following steps: 1) providing at least one low-softening point thermoplastic core component, and at least one high-softening point sheath component to the respective core and sheath portions of a sheath-and-core type conjugate spinning die under extrusion conditions; 2) extruding the components into conjugate filaments, each conjugate filament have a sheath composed of at least one high-softening point component that substantially envelops a core composed of at least one low-softening point thermoplastic component; 3) quenching the extruded conjugate filaments downstream of the spinning die; 4) drawing the extruded conjugate filaments as they are being quenched thereby achieving an average filament diameter ranging from about 0.5 to about 100 microns; and 5) applying a flattening force to durably distort the core of individual filaments into a ribbon-like configuration while the low-softening point component is at a temperature near its softening point so that a substantial portion of the individual filaments have a width to height ratio of greater than about 2:1.

According to the method of the invention, the low-softening point thermoplastic component in the core may have a viscosity that is greater than or near the viscosity of the high-softening point component in the sheath while the components are being extruded.

It is desirable that a substantial portion of the low-softening point thermoplastic component in the core may have a softening point that is at least about 50° C. lower than the softening point of the high-softening point component in the sheath.

Generally speaking, the individual filaments are at a temperature near the softening point of the low-softening point thermoplastic component during application of the flattening force. The flattening force may be applied by a calendar roll arrangement (e.g., pressure roll arrangement). Desirably, the calendar roll arrangement is a heated calendar roll arrangement (e.g., heated pressure roll arrangement).

The method of the present invention may further include the step of introducing an expanding agent into the high-melt temperature sheath component prior to extrusion so that, upon extrusion, the expanding agent expands to produce a textured sheath. In another aspect of the invention, the components are extruded into conjugate filaments using a multi-lobal sheath-and-core type conjugate spinning die so that multiple lobes are generated on the sheath. In yet another aspect of the invention, an expanding agent is introduced into the high-melt temperature sheath component prior to extrusion through a multi-lobal sheath-and-core type conjugate spinning die so that, upon extrusion, the expanding agent expands to produce a textured sheath having multiple lobes.

The present invention further encompasses ribbon-like, conjugate, spun filaments composed of: 1) from about 50 to about 99 percent, by weight, of a low-softening point thermoplastic component forming a ribbon-like core; and 2) from about 1 to about 50 percent, by weight, of a high-softening point component forming a sheath that substantially envelops the core; in which the filaments have been durably flattened to a width to height ratio of greater than about 2:1. For example, the filaments may be composed of from about 70 to about 99 percent, by weight, of a low-softening point thermoplastic component forming a core and from about 1 to about 30 percent, by weight, of a high-softening point component forming a sheath.

According to the invention, the high-softening point component may be, for example, one or more polyesters, polyamides, high-softening point polyolefins, and blends of the same. The low-softening point thermoplastic component may be, for example, one or more low-softening point polyolefins, low-softening point elastomeric block copolymers, and blends of the same.

In one embodiment of the invention, the sheath component of the conjugate filaments may include a distribution of rugosities (bumps, fissures, microfibrils, cavities, etc.) across at least a portion of the surface of the sheath. In another embodiment of the invention, the sheath portion of the conjugate filaments may include multiple lobes across at least a portion of the surface of the sheath. In another embodiment of the invention, the sheath portion of the conjugate filaments may include rugosities as well as multiple lobes across at least a portion of the surface of the sheath. Desirably, the conjugate filaments may be conjugate, spunbond filaments.

According to the invention, the filaments may incorporate substances that reflect ultra-violet wavelength radiation, absorb ultra-violet wavelength radiation, retard photodegradation, absorb moisture, adsorb odors, and/or are antimicrobial.

DETAILED DESCRIPTION OF THE INVENTION

The present invention is directed to a method of making a flexible fabric composed of a fibrous matrix of ribbon-like, conjugate, spun filaments as well as the fabrics and filaments themselves. While the invention will be described in connection with desired or preferred embodiments, it will be understood that it is not intended to limit the invention to those embodiments.

Figure 1:
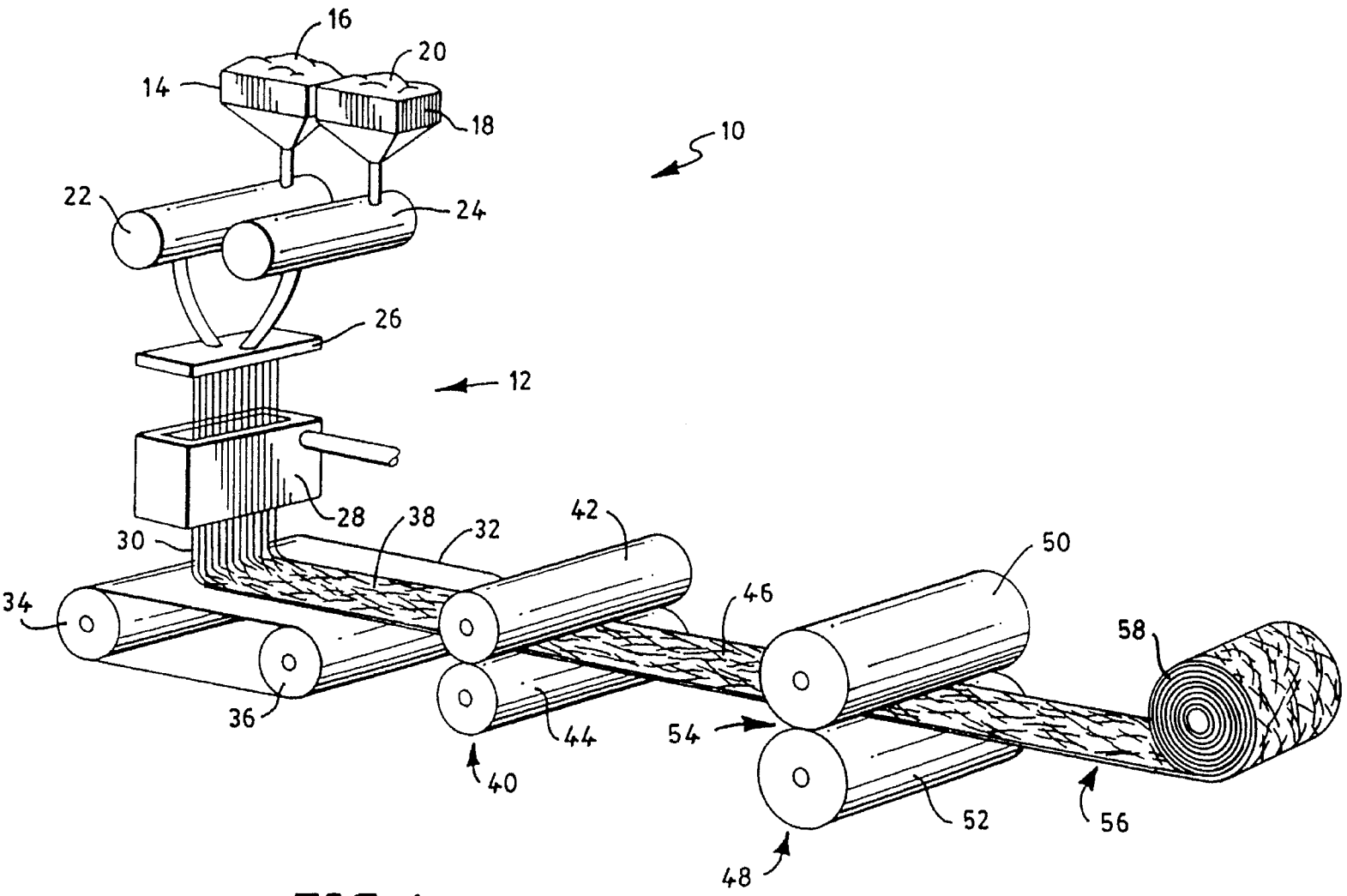
FIG. 1 is an illustration of an exemplary method for producing a flexible fabric composed of a fibrous matrix of ribbon-like, conjugate, spun filaments.

Referring now to FIG. 1 of the drawings, there illustrated at 10 an exemplary method for producing a flexible fabric. A conventional fabric-forming machine for forming a spunbond fabric (i.e., spunbond web) composed of a fibrous matrix of a plurality of substantially continuous conjugate filaments. The fabric-forming machine includes a conjugate spunbond filament station 12 (referred to as "spunbond station 12") having a first supply container 14 which holds a supply of an extrudable core polymer 16. The core polymer 16 is a polymer characterized as a low-softening point thermoplastic material (e.g., one or more low-softening point polyolefins, low-softening point elastomeric block copolymers, and blends of the same).

A second supply container 18 which holds a supply of an extrudable sheath polymer 20 is also part of the spunbond station 12. The sheath polymer 20 is a polymer characterized as a high-softening point material. (e.g., one or more polyesters, polyamides, high-softening point polyolefins, and blends of the same). Desirably, the sheath polymer 20 is a thermoplastic polymer. It is contemplated that modified spunbond stations may be adapted to incorporate other polymers as the sheath material.

The supply containers 14 and 18 in the spunbond station 12 feed into conventional extruders 22 and 24. The polymers are heated and extruded in the form of conjugate (i.e., sheath-core) filaments through a plurality of holes in a sheath-and-core type spinnerette 26. The polymers are continuously extruded through one or more spinnerette to form discrete conjugate filaments. The spun filaments are simultaneously quenched and drawn by means of a take-off device 28. The filaments are drawn either mechanically or pneumatically, without breaking, in order to molecularly orient at least the core polymer portion of the conjugate filaments to generally improve strength and tenacity. The resulting filaments are composed of: (i) a core formed of the core polymer 16 (i.e., at least one low-softening point thermoplastic component); and (ii) a sheath formed of the sheath polymer 20 (i.e., at least one high-softening point component).

The drawn, continuous filaments 30 are deposited in a substantially random, intertwined manner on a moving, endless foraminous carrier belt 32 driven over spaced-apart rolls 34 and 36, thereby forming a fibrous matrix 38. An appropriate suction means (not illustrated) can be present to assist the web formation on the carrier belt 32. The drawn, continuous filaments 30 may also be deposited in a generally oriented configuration to produce a more oriented fibrous matrix 38.

The fibrous matrix 38 then passes through a pattern-bonding station 40 composed of pattern roll 42 and an anvil roll 44. The pattern bond station bonds the fibrous matrix 38 at discrete, spaced-apart locations to produce a fabric 46. Generally speaking the pattern-bonding at discrete, spaced-apart locations enhances the coherency of the fabric 46.

From the pattern-bonding station 40, the fabric 46 passes to a heated pressure roll station 48 composed of heated pressure rolls 50 and 52 forming a heated pressure nip 54. The actual operating temperature and pressure generated by the heated pressure rolls 50 and 52 should be determinable by one of ordinary skill in the are and will depend upon factors including, but not limited to, the types of polymers in the filaments, the temperature of the low-softening point component just as the fabric enters the pressure nip 54, the dwell time of the fabric 46 in the pressure nip 54 of the rolls, the amount of durable distortion in the filament core that is desired, and the presence, if any, of other materials in the fabric 46 (e.g., secondary materials) or in the filaments (e.g., additives such as, for example, UV (ultraviolet) radiation reflecting substances or UV radiation absorbing substances, etc.). At the pressure roll station 48, the fabric 46 passes through the heated pressure nip 54 formed by the pressure rolls and the individual filaments are durably distorted into a ribbon-like configuration. It is contemplated that a cooling gas or liquid could be applied to the fabric upon exiting the pressure roll station. Alternatively and/or additionally, the fabric may be passed over chill rolls.

The resulting treated fabric 56 may be formed into a roll 58 or conveyed directly into other processes such as, for example, fabric converting operations (not illustrated).

Figure 2:
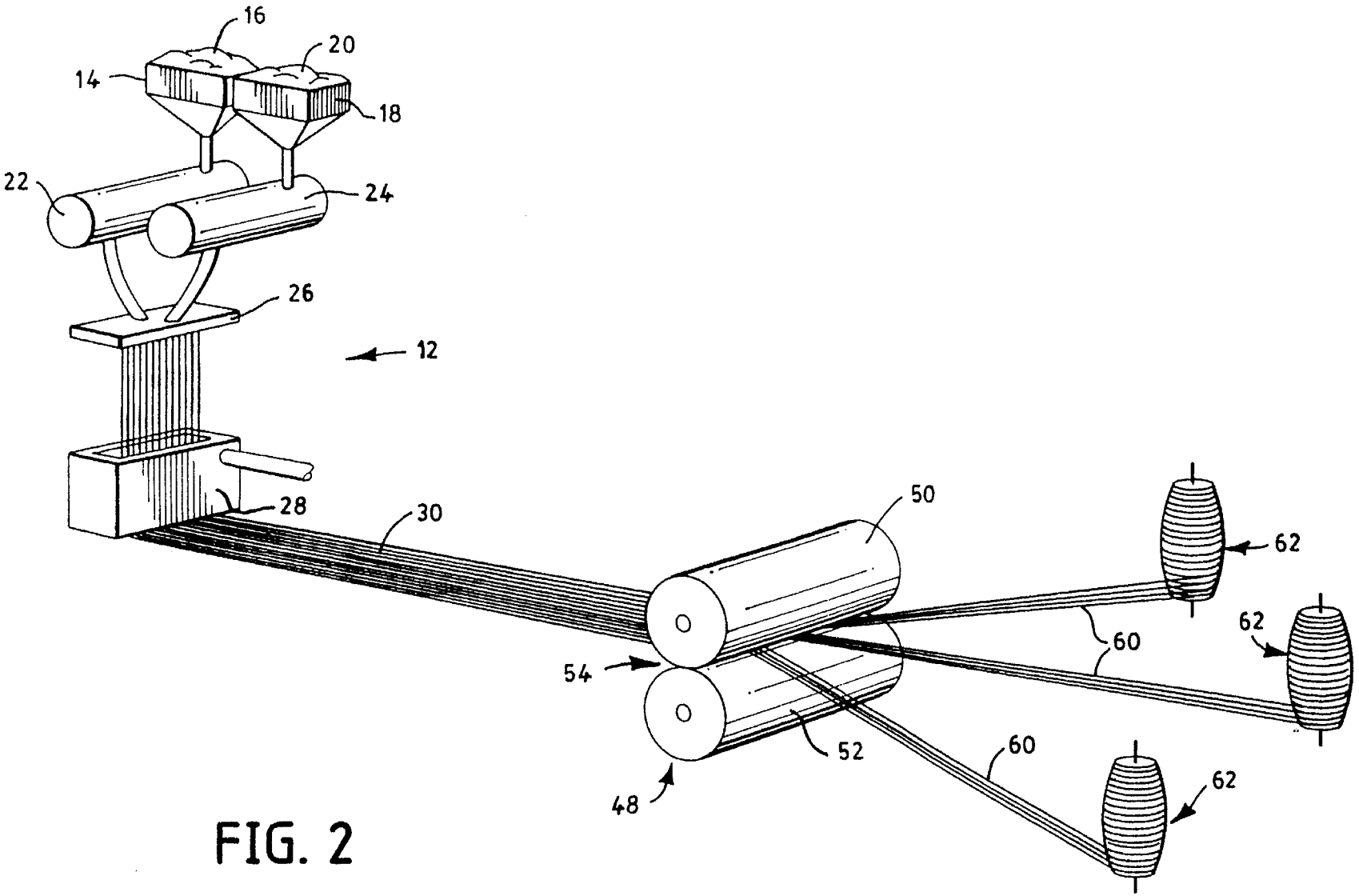
FIG. 2 is an illustration of an exemplary method for producing ribbon-like, conjugate, spun filaments.

In an aspect of the invention, the drawn, continuous filaments 30 may entirely bypass deposition on the carrier belt 32 and formation into a fibrous matrix 38 as well as subsequent conversion into a fabric 46 due to bonding by the pattern bonding station 40. Instead, the filaments may be maintained as discrete, separate filaments that are passed directly to the pressure roll station 48 as depicted in FIG. 2. At the pressure roll station 48, discrete, separate filaments 30 pass through the heated pressure nip 54 formed by pressure rolls 50 and 52 and are durably distorted into a ribbon-like configuration resulting in individualized, continuous, ribbon-like filaments 60. The individualized, continuous, ribbon-like filaments 60 may by wound up in spools or bobbins 62, conveyed directly into other processes such as, for example, yarn or thread converting operations, weaving operations, and/or knitting operations (not illustrated), or cut into lengths for use as staple-length fibers and/or staple-length filaments.

In another aspect of the invention, the drawn, continuous filaments 30 may entirely bypass deposition on the carrier belt 32 and formation into a fibrous matrix 38, subsequent conversion into a fabric 46 at the pattern bonding station 40 as well as immediate flattening of the core into a ribbon-like configuration at the pressure roll station 48. Instead, the filaments may be maintained as discrete, separate filaments that can be conveyed to weaving or knitting operations for manufacturing into a woven or knitted fabric. At a later point, the woven or knitted fabric may be conveyed through a heated pressure nip formed by heated pressure rolls and durably distorted into a ribbon-like configuration resulting in woven or knit fabric composed of substantially ribbon-like filaments.

The spunbond station 12 may be a conventional conjugate filament extruder with one or more spinnerettes which form continuous conjugate filaments of a polymer and deposit those filaments onto the carrier belt 32 in a random, intertwined fashion (or oriented fashion) to form the fibrous matrix 38. The spunbond station 12 may include one or more conjugate filament spinnerette heads depending on the speed of the process and the particular polymers being used. It is contemplated that other filament and/or fiber processes may be used to deposit mono-component or multi-component filaments and/or fibers either into and/or onto the fibrous matrix 38.

The conjugate filaments of the present invention are substantially ribbon-like. That is, individual filaments have been durably distorted so their widest cross-sectional dimension of the filaments is generally greater than about two (2) times the narrowest cross-sectional dimensional dimension. For example, the widest cross-sectional dimension of the filaments may generally be greater than three (3) or more times the narrowest cross-sectional dimensional dimension. This phenomena is conveniently express as a width to height ratio. For example, durably distort individual filaments may have a width to height ratio generally greater than about 2:1. As another example, the individual filaments may be durably distorted to a width to height ratio generally greater than about 3:1.

It is highly desirable that the sheath component not melt or significantly soften during the calendaring operation thereby avoiding significant fusion between the sheath surfaces (i.e., exterior surfaces of sheaths on individual filaments) which would impair the flexibility of the fabric. At the same time, it is highly desirable that the core component significantly softens or melts so that it is malleable or deformable. The softened core component, under the pressure (and, if applicable, heat) of the calendaring process, will distort and flatten, durably changing the overall shape of the filament and/or fiber as well as properties or characteristics of the fabric.

In order to enhance flattening or distortion of the filaments, it is also highly desirable that a substantial portion of the low-softening point thermoplastic component in the core have a softening point that is at least about 50° C. lower than the softening point of the high-softening point component in the sheath. For example, the low-softening point thermoplastic component in the core may have a softening point that is at least about 70° C. lower than the softening point of the high-softening point component in the sheath. This may be accomplished by appropriate polymer selection.

Generally speaking, the fibrous matrix 38 composed of conjugate filaments 30 (or individual conjugate filaments in some embodiments) is generally at a temperature near the softening point of the low-softening point thermoplastic component of the filaments during application of the flattening force by the heated pressure rolls 50 and 52. For example, the fibrous matrix 38 may be at a temperature near the softening point of the low-softening point thermoplastic component during application of the flattening force due to heat generated substantially by application of the flattening force by the pressure rolls 50 and 52 while the rolls remain un-heated. As another example, the fibrous matrix 38 may be at a temperature near the softening point of the low-softening point thermoplastic component during application of the flattening force due to heat retained within the filaments after formation. As yet another example, the fibrous matrix 38 may be at a temperature near the softening point of the low-softening point thermoplastic component during application of the flattening force due to heat applied to the fibrous matrix 38 after formation of the filaments by optional heat applying means (not illustrated). Heat may be applied by means or techniques including, but not limited to, infrared radiation, steam cans, heated rolls, hot ovens, microwaves, ultrasonic radiation, flame, hot gases, hot liquid, and radio frequency heating.

As discussed above, a desirable aspect of the present invention is to produce a woven or nonwoven fabric having sheath/core conjugate filaments and/or fibers that, when calendared (i.e., passed through the pressure nip 54 of the pressure rolls 50 and 52), will durably distort (e.g., flatten) in the general planar dimension of the fabric 46. More particularly, calendaring the conjugate filaments with pressure and/or heat, should cause durable distortion of the filament cores but not the filament sheaths.

An even more desirable aspect of the present invention is that, after the calendaring operation, the filaments and/or fibers remain substantially unattached between the discrete, spaced-apart bond locations. That is, the ribbon-like filaments and/or fibers substantially retain their individuality, (i.e., they do not stick together) because the sheath does not soften during the calendaring step. Generally speaking, this would be difficult to accomplish with a fabric formed of mono-component filaments/fibers because the temperature conditions necessary to achieve softening of the filament/fibers so they could be durably distorted (i.e., flattened) would also tend to cause the filaments/fibers to fuse or bond together under pressure. The relative absence of bonding or fusing of individual ribbon-like filaments and/or fibers between the spaced apart bond locations typically results in extra softness and enhanced drape (e.g., less stiffness) of the fabric. In addition, in those cases where the sheath is texturized, the calendared filaments and/or fibers retain their texturization due to lack of softening of the sheath during the calendaring step.

In order to increase the likelihood that the filaments remain substantially unattached or unfused between the spaced apart bond locations, the low-softening point thermoplastic component in the core may have a viscosity that is greater than or equal to the viscosity of the high-softening point component in the sheath while the components are being extruded. That is, when spinning sheath/core conjugate filaments and/or fibers, it is desirable that the core polymer's viscosity (at processing conditions) be equal to or greater than the viscosity of the sheath polymer's viscosity (at processing conditions). This generally prevents migration of the core polymer to the walls of the dye tip and into the sheath component. Presence of the core polymer in the sheath could increase the likelihood that the sheath components of individual filaments and/or fibers would undesirably fuse or bond together.

It is expected that, in some embodiments of the invention, the core polymer viscosity (at processing conditions) may be equal to or even slightly lower than the sheath polymer viscosity (at processing conditions). At this time, it is not well understood how much lower the core polymer viscosity (at processing conditions) may be (relative to the sheath polymer viscosity) to produce a satisfactory fabric with little or no fusion or bonding of the sheath components.

For example, if conventional melt-spinning grade polyethylene is used in the core and conventional melt-spinning grade polypropylene in the sheath under conventional conjugate filament melt-spinning conditions of around 200° C. it is possible that the lower viscosity polyethylene may start to migrate into the sheath component and be present at or about the outer regions of the sheath.

This might occur if shear thinning of the polymer, normally present during the melt-spinning of polypropylene, but not in polyethylene, is not significant enough to maintain the relative difference in viscosities. To avoid this problem, it is possible to lower the viscosity of the polypropylene sheath (even further than what might be attributed to "shear thinning" by adding a peroxide-type resin to the blend to lower the average molecular weight of the polypropylene component in the sheath. For example, it is contemplated that a blend composed of about 66 percent, by weight, melt-blowing grade polypropylene resin (containing peroxide additives that lower the molecular weight of the polypropylene polymer) available under the trade designation HiMont 015 (HiMont Company), and about 34 percent, by weight, spunbond-grade polypropylene (containing no peroxide additives that lower the molecular weight of the polypropylene polymer).

Alternatively, it is possible to substitute the polyethylene in the core with a polymer having a low melting/softening temperature but a high processing viscosity. Examples of such polymers include, but are not limited to, KRATON® series elastomeric block copolymers (available from the Shell Chemical Company, Houston, Tex.) and certain polystyrene resins. These materials have melting points ranging from about 90° to about 100° C. If the viscosity of these materials is too high, a flow modifier such as, for example, low density polyethylene (LDPE Quantum NA 601-04—a polyethylene "wax" available from Quantum Chemical Company) may be compounded into, for example, the KRATON® series elastomeric block copolymers. The resultant KRATON® elastomeric block copolymer/polyethylene wax blend would still have a low softening point. More detailed description of such blends is contained in U.S. Pat. No. 4,663,220, the contents of which is incorporated herein by reference.

Since the melting/softening point of conventional grades of polypropylene is around 170° C. and that of conventional grades of polyethylene is 120° C., it may be advantageous to use a polymer in the core with an even lower melting/softening point than polyethylene. Examples of such polymers include, but are not limited to, KRATON® series elastomeric block copolymers or polystyrene resins, which have tend to have softening points in the range of about 90° to about 100° C. Use of these polymers would generally permit relatively cooler temperatures in the pressure nip of the heated pressure rolls and would generally minimize the effect of calendaring on the outer sheath (especially if sheath is texturized using blowing agent).

Even if individual filaments remain substantially unattached between the bond points, it may be desirable to introduce the fabric to a mechanical softening step after the flattening force is applied at the pressure roll station 48. Mechanical softening may be carried out using techniques including, but not limited to, intermeshed grooved rolls, intermeshed patterned rolls, liquid jets and gas jets. The gas jets may be high-pressure jets of air. The liquid jets may be high-pressure jets of water.

According to another embodiment of the invention, an expanding agent may be incorporated into the sheath polymer 24 prior to extrusion so that, upon extrusion, the expanding agent expands to produce a textured sheath. Suitable expanding agents include, but are not limited to $CO_2$, $H_2O$, acetone or other solvents, and various blowing and/or foaming agents.

The expanding agent in the sheath polymer expands upon extrusion to produce voids, bubbles, microfibrils, and other morphological or surface texture changes, while the core polymer serves as a backbone, imparting strength and integrity to the total fiber, allowing it to be drawn with minimal breakage.

Generally speaking, if a higher ratio of core polymer to sheath polymer/expanding agent is used, it is thought that more efficient texturization will be obtained for a given amount of expanding agent because the expanding agent (and its resulting bubbles) are confined to a correspondingly thinner layer of sheath polymer. In addition, it is thought that the resulting sheath/core filaments will have enhanced drawability because the majority of the polymer mass is the un-expanded core.

Texturization of the filaments helps eliminate the slick "waxy" feel normally attributed to fabrics made from some types of materials (e.g., some polyolefin filaments composed of smooth (i.e., non-textured) filaments and/or fibers). Eliminating or reducing the slick "waxy" feel results in a fabric having a desirable attribute often referred to as "cloth-like".

Figure 3:
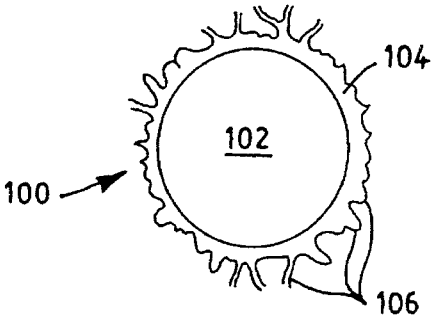
FIG. 3 is a cross-sectional view of an exemplary textured, conjugate filament having a generally circular configuration.

Referring now to the FIGS. 3–10, a cross-section of a conjugate filament 100 having a generally circular configuration is illustrated in FIG. 3. More particularly, FIG. 3 shows a conjugate filament 100 having a generally circular core 102 that is enveloped by a sheath 104. The sheath 104 is textured and has fibrils 106.

Figure 4:
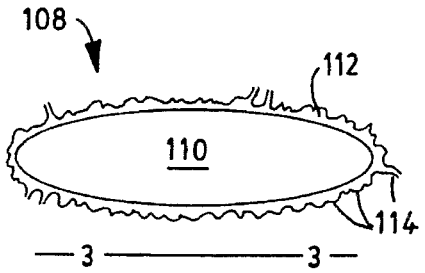
FIG. 4 is a cross-sectional view of an exemplary textured, conjugate filament having a generally ribbon-like configuration.

FIG. 4 depicts a cross-section of an exemplary conjugate filament 108 having a generally ribbon-like configuration. More particularly, FIG. 4 illustrates a durably distorted ribbon-like conjugate filament 108 produced by applying a flattening force (i.e., pressure and temperature) to the filament 100 depicted in FIG. 3. The resulting conjugate filament 108 has a generally ribbon-like core 110 that is enveloped by a sheath 112. The sheath 112 is textured and has fibrils 114. Although the sheath 112 envelopes the ribbon-like core 110 and conforms to its generally ribbon-like configuration, the sheath 112 itself is relatively unchanged or unaffected by the applied temperature and pressure.

It should be noted that the core 110 has a width dimension running generally parallel with line 3—3 and a height dimension running perpendicular to line 3—3. From FIG. 4, it can be seen that the core 110 appears to have a width to height ratio of about 6:1. This can be compared to FIG. 3 where it appears that the core 102 has a width to height ratio of about 1:1.

Figure 5:
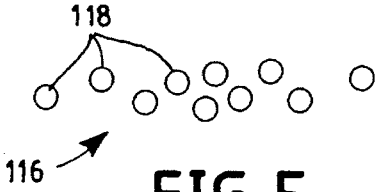
FIG. 5 is a cross-sectional view of an exemplary fabric containing individual conjugate filaments having a generally circular configuration.

Referring now to FIG. 5, what is shown is a cross-sectional view of a fabric 116 having a series of selected individual conjugate filaments 118 in a portion of a fabric 116. The filaments 118 have a generally circular configuration.

Figure 6:
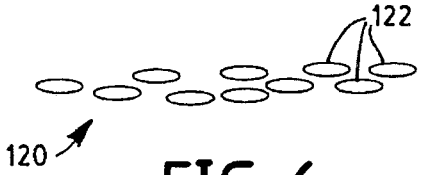
FIG. 6 is a cross-sectional view of an exemplary fabric containing individual conjugate filaments having a generally ribbon-like configuration.

FIG. 6 depicts a cross-sectional view of a fabric 120 containing a series of selected individual conjugate filaments 122 having a generally ribbon-like configuration. More particularly, FIG. 6 shows series of durably distorted ribbon-like conjugate filaments 122 produced by applying a flattening force (i.e., pressure and temperature) to the filaments depicted in FIG. 5.

Figure 7:
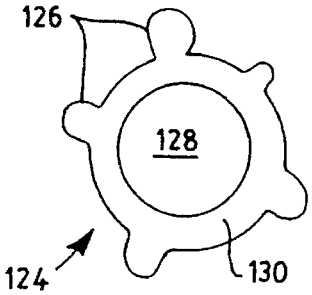
FIG. 7 is a cross-sectional view of an exemplary multi-lobed, conjugate filament having a generally circular configuration.

FIG. 7 is a cross-sectional view of an exemplary multi-lobed conjugate filament 124 having a generally circular configuration and protruding lobes 126. More particularly, FIG. 7 shows a conjugate filament 124 having a generally circular core 128 that is enveloped by a sheath 130. The sheath 130 contains several lobes 124 that are integral to the sheath 130.

Figure 8:
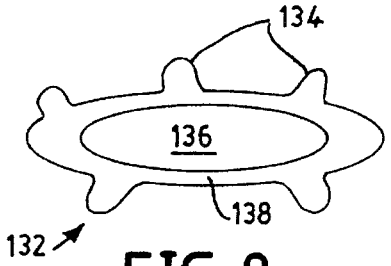
FIG. 8 is a cross-sectional view of an exemplary multi-lobed, conjugate filament having a generally ribbon-like configuration.

FIG. 8 depicts a cross-section of an exemplary multi-lobed conjugate filament 132 having a generally ribbon-like configuration and protruding lobes 134. More particularly, FIG. 8 shows a durably distorted ribbon-like multi-lobed conjugate filament 132 produced by applying a flattening force (i.e., pressure and temperature) to the filament depicted in FIG. 7. The resulting conjugate filament 132 has a generally ribbon-like core 136 that is enveloped by a sheath 138. The sheath 138 has lobes 134. Although the sheath 138 envelopes the ribbon-like core 136 and conforms to its generally ribbon-like configuration, the sheath 138 itself is relatively unchanged or unaffected by the applied temperature and pressure.

Figure 9:
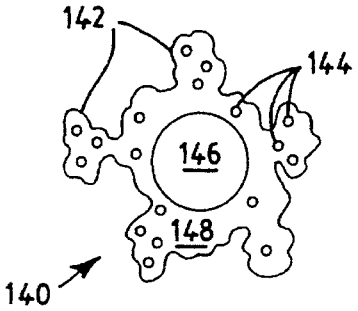
FIG. 9 is a cross-sectional view of an exemplary multi-lobed, textured conjugate filament having a generally circular configuration.

FIG. 9 is a cross-sectional view of an exemplary multi-lobed, textured conjugate filament 140 having a generally circular configuration, protruding lobes 142, and textured portions 144 (e.g., fibrils and bumps). More particularly, FIG. 9 shows a conjugate filament 140 having a generally circular core 146 that is enveloped by a sheath 148. The sheath 148 contains several lobes 144 that are integral to the sheath 148 as well as a distribution of textured portions 144.

Figure 10:
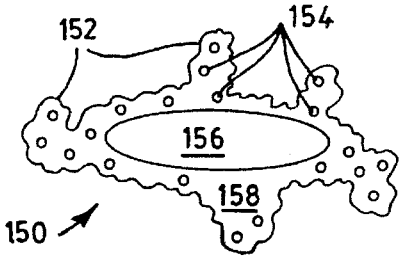
FIG. 10 is a cross-sectional view of an exemplary multi-lobed, textured conjugate filament having a generally ribbon-like configuration.

FIG. 10 depicts a cross-section of an exemplary multi-lobed, textured conjugate filament 150 having a generally ribbon-like configuration, protruding lobes 152 and textured portions 154 (e.g., fibrils and bumps). More particularly, FIG. 10 shows a durably distorted ribbon-like, multi-lobed, textured conjugate filament 150 produced by applying a flattening force (i.e., pressure and temperature) to the filament depicted in FIG. 9. The resulting conjugate filament 150 has a generally ribbon-like core 156 that is enveloped by a sheath 158. The sheath 158 has lobes 152 and textured portions 154. Although the sheath 158 envelopes the ribbon-like core 156 and conforms to its generally ribbon-like configuration, the sheath 158 itself is relatively unchanged or unaffected by the applied temperature and pressure.

It is envisioned that satisfactory fabrics composed of ribbon-like filaments may be formed using a bi-component spunbond process in which a conventional spunbond-grade or reduced molecular weight polypropylene forms the sheath component and a conventional spunbond-grade polyethylene forms the core component of melt-spun filaments. The filaments can be simultaneous drawn and quenched and then deposited on a carrier belt to form a fibrous matrix. The matrix can then be bonded to form a conventional bi-component spunbond web having a surface area cover of about 25 percent. The web can be reheated to about the softening temperature of the polyethylene core using a hot air stream. It is envisioned that the heated web can be calendared with sufficient pressure to flatten the filaments to a width to height ratio of 3 to 1, resulting in a spunbond web providing approximately 75 percent cover (i.e., a 300 percent increase in the spunbond web's covering ability).

As can be seen from FIGS. 3–10, the ribbon-like configuration of the filaments and their overall orientation tends to minimize the "percent open area" of fabrics made from the filaments. That is, the ribbon-like configuration of the filaments generally maximizes the opaqueness, or the "cover", of the fabric. This is particularly evident in FIG. 6, in which the widest cross-sectional filament dimensions are oriented generally parallel to surface of the fabric.

This attribute is advantageous in a variety of applications where maximum "cover" and minimum basis weight is desirable in a material which still retains fabric like properties such as flexibility and softness. One such useful application would be in filters where it is desirable to have a fabric or fibrous matrix with minimum web opening sizes.

As another example, this attribute of minimum percent open area (maximum "cover") is also valuable in producing a nonwoven fabric for garments or devices designed to shield the wearer/user from harmful UV-B and UV-A rays. With the proper UV-absorbing and/or UV-reflecting internal additives, a high-SPF (sun protection factor) UV-blocking garment made of such a light-blocking fabric could achieve SPFs of >10 wet and/or dry (e.g., >30 wet and/or dry). This compares very favorably with conventional woven cotton T-shirt material that has a SPF value of approximately 5 to 10. Such a high SPF fabric would eliminate the need for topical liquid sunscreens. Liquid sunscreens have disadvantages such as, for example, incomplete coverage, temporary protection (ie., it washes off), stains, possible allergic reactions, blocks only UV-B rays, relatively expensive for extended uses.

Maximum "cover" is generally useful in many other fabric applications because it allows fabrics/webs to be of a lighter basis weight for a given desired "percent open area", e.g., for a given desired "cover". Other exemplary uses include, but are not limited to, tarps, umbrellas, curtains, lightweight car covers, and so forth.

The attributes of both maximum "cover" and texturization combine to give a unique fabric (e.g., a conjugate spunbond filament fabric) having unique functional characteristics. For example, some of these characteristics include: cloth-like feel, light-blocking ability, relatively high surface area, flexibility, softness, and breathability. There are practical, economic advantages as well. For example, many of these fabrics may be made from relatively inexpensive raw materials (e.g., polypropylene, polyethylene and expanding agents) using relatively simple manufacturing processes (e.g., conventional conjugate sheath/core filament extrusion processes and conventional pressure roll processes). The resulting fabrics can provide desirable levels of "cover" or screening at basis weights that are relatively lower than conventional fabrics. This serves to lower the raw material costs. Furthermore, many of the materials can be recycled.

According to the invention, various fabric and/or fiber attributes may be obtained by incorporating certain substances (e.g., internal additives or coatings) into conjugate filaments and/or fibers. These substances may be added to the sheath and/or core of the conjugate filaments and/or fibers. For example, in addition to enhancing the above-described UV-absorbing and/or reflecting attributes, specific additives may give fibers the ability to resist or inhibit photodegradation, absorb water and/or odors, as well as kill germs. Accordingly, the filaments/fibers may incorporate one or more substances including, but not limited to, ultra-violet wavelength radiation reflectors, ultra-violet wavelength radiation absorbers, moisture absorbers, odor adsorbers, and/or anti-microbial agents.

The ability to absorb water (i.e., moisture) may prevent static build-up by reducing or eliminating the dielectric properties of the filaments/fibers. Additionally, the fabrics may be designed to absorb perspiration. These fabrics would generally be perceived as more cotton-like. Such cotton-like fabrics and garments made from such fabrics would enhance the sensation or impression of comfort, especially in combination with the fabric's softness and flexibility.

Fabrics that adsorb odors could be used in filtration materials or in garments where adsorption of body odor is desirable. Fabrics that have anti-microbial or germ-killing properties could be used to kill or prevent growth of microbes that generate odors and, in some instances, create stains.

Substances that may be incorporated into the sheath and/or core components of the filaments/fibers of the fabrics include, but are not limited to the following: ultra-violet wavelength light reflectors such as micronized titanium dioxide and micronized zinc dioxide; ultra-violet wavelength light absorbers such as magnesium sulfate, micronized titanium dioxide, micronized zinc dioxide, as well as products available under the trademark Tinuvin from CIBA-GEIGY Corporation; photodegradation inhibitors such as hindered amines, hindered phenols as well as products available under the trademarks Tinuvin and/or Chimassorb from CIBA-GEIGY Corporation; water absorbers such as magnesium sulfate (i.e., $MgSO_4*n(H_2O)$) polyacrylate superabsorbents, aluminum oxide, calcium oxide, silicon oxide, barium oxide, cobalt chloride, and polyvinyl alcohol; odor adsorbers such as activated carbon and odor adsorbing zeolites; and anti-microbial or germ-killing agents such as Microban® available from the Microban Corporation of Huntsville, N.C.

While the present invention has been described in connection with certain desired or preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A method of making a flexible fabric comprising a fibrous matrix of ribbon-like, conjugate, spun filaments, the method comprising the following steps:

providing a fibrous matrix comprising individual, spun filaments bonded at spaced-apart bond locations, the filaments comprising:

a core composed of at least one low-softening point thermoplastic component, and a sheath composed of at least one high-softening point component;

applying a flattening force to the fibrous matrix to durably distort the core of individual filaments into a ribbon-like configuration having a width greater than its height so that:

the individual filaments are substantially unattached between the spaced-apart bond locations, and the width of individual filaments is oriented substantially in the planar dimension of the fabric.

2. The method of claim 1 wherein the fabric is at a temperature near the softening point of the low-softening point thermoplastic component during application of the flattening force.

3. The method of claim 1 wherein the flattening force is applied by a calendar roll arrangement.

4. The method of claim 3 wherein the calendar roll arrangement is a heated calendar roll arrangement.

5. The method of claim 1 wherein a substantial portion of the low-softening point thermoplastic component in the core has a softening point that is at least about 50° C. lower than the softening point of the high-softening point component in the sheath.

6. The method of claim 1 wherein the low-softening point thermoplastic component in the core has a softening point that is at least about 70° C. lower than the softening point of the high-softening point component in the sheath.

7. The method of claim 1 wherein the fibrous matrix is mechanically softened after the flattening force is applied.

8. The method of claim 7 wherein the mechanical softening is carried out by methods selected from intermeshed grooved rolls, intermeshed patterned rolls, liquid jets and gas jets.

9. The method of claim 1 wherein the individual filaments are durably distorted to a width to height ratio of greater than about 2:1.

10. The method of claim 1 wherein the individual filaments are durably distorted to a width to height ratio of greater than about 3:1.

11. A method of making ribbon-like, conjugate, spun filaments, the method comprising the following steps:

providing at least one low-softening point thermoplastic core component, and at least one high-softening point sheath component to the respective core and sheath portions of a sheath-and-core type conjugate spinning die under extrusion conditions;

extruding the components into conjugate filaments, each conjugate filament have a sheath composed of at least one high-softening point component that substantially envelops a core composed of at least one low-softening point thermoplastic component;

quenching the extruded conjugate filaments downstream of the spinning die;

drawing the extruded conjugate filaments as they are being quenched thereby achieving an average filament diameter ranging from about 0.5 to about 100 microns; and applying a flattening force to durably distort the core of individual filaments into a ribbon-like configuration having a width to height ratio of greater than about 2:1.

12. The method of claim 11, wherein the low-softening point thermoplastic component in the core has a viscosity that is greater than or equal to the viscosity of the high-softening point component in the sheath while the components are being extruded.

13. The method of claim 11, wherein the individual filaments are a temperature near the softening point of the low-softening point thermoplastic component during application of the flattening force.

14. The method of claim 11, wherein the flattening force is applied by a calendar roll arrangement.

15. The method of claim 14, wherein the calendar roll arrangement is a heated calendar roll arrangement.

16. The method of claim 11, wherein a substantial portion of the low-softening point thermoplastic component in the core has a softening point that is at least about 50° C. lower than the softening point of the high-softening point component in the sheath.

17. The method of claim 16, wherein the low-softening point thermoplastic component in the core has a softening point that is at least about 70° C. lower than the softening point of the high-softening point component in the sheath.

18. The method of claim 11, further comprising the step of introducing an expanding agent into the high-melt temperature sheath component prior to extrusion so that, upon extrusion, the expanding agent expands to produce a textured sheath.

19. The method of claim 11, wherein the components are extruded into conjugate filaments using a multi-lobal sheath-and-core type conjugate spinning die so that multiple lobes are generated on the sheath.

20. The method of claim 11, further comprising the step of introducing an expanding agent into the high-melt temperature sheath component prior to extrusion so that, upon extrusion into conjugate filaments using a multi-lobal sheath-and-core type conjugate spinning die, the expanding agent expands to produce a multi-lobed, textured sheath.

21. A flexible fabric comprising a fibrous matrix of ribbon-like, conjugate, spun filaments joined at spaced apart bond locations, the filaments comprising:

a ribbon-like core having a greater width than height and composed of at least one low-softening point thermoplastic component, and a sheath composed of at least one high-softening point component, the sheath substantially enveloping the core;

wherein the individual filaments are: (i) substantially unattached between the spaced-apart bond locations, and (ii) oriented so that their widths are substantially in the planar dimension of the fabric.

22. The flexible fabric of claim 21, wherein the conjugate filaments comprise from about 1 to about 50 percent, by weight, of the high-softening point component and from about 50 to about 99 percent, by weight, of the low-softening point thermoplastic component.

23. The flexible fabric of claim 21 wherein the high-softening point component is selected from polyesters, polyamides and high-softening point polyolefins.

24. The flexible fabric of claim 21, wherein the low-softening point thermoplastic component is selected from low-softening point polyolefins, low-softening point elastomeric block copolymers, and blends of the same.

25. The flexible fabric of claim 21, further comprising a secondary material selected from fibers and particulates.

26. The flexible fabric of claim 21, wherein the sheath includes a distribution of rugosities across at least a portion of the surface of the sheath.

27. The flexible fabric of claim 21, wherein the sheath includes multiple lobes across at least a portion of the surface of the sheath.

28. The flexible fabric of claim 21, wherein the sheath includes multiple lobes and a distribution of rugosities across at least a portion of the surface of the sheath.

29. The flexible fabric of claim 21, wherein the individual filaments are durably flattened to a width to height ratio of greater than about 2:1.

30. The flexible fabric of claim 21, wherein the fabric provides a surface area coverage at least about 10 percent greater than an identical but untreated fabric of filaments having a substantially circular cross-section.

31. The flexible fabric of claim 21, wherein the fibrous matrix is selected from woven fabrics, knit fabrics and nonwoven fabrics.

32. The flexible fabric of claim 31, wherein the fibrous matrix is a nonwoven web of conjugate, spunbond filaments.

33. The flexible fabric of claim 21, wherein the ribbon-like, conjugate, spun filaments incorporate a substance that reflects ultra-violet wavelength radiation.

34. The flexible fabric of claim 33, wherein the substance that reflects ultra-violet wavelength radiation is selected from micronized titanium dioxide and micronized zinc dioxide.

35. The flexible fabric of claim 21, wherein the ribbon-like, conjugate, spun filaments incorporate a substance that absorbs ultra-violet wavelength radiation.

36. The flexible fabric of claim 35, wherein the substance that absorbs ultra-violet wavelength radiation is selected from magnesium sulfate, micronized titanium dioxide and micronized zinc dioxide.

37. The flexible fabric of claim 21, wherein the ribbon-like, conjugate, spun filaments incorporate a substance that inhibits photodegradation.

38. The flexible fabric of claim 37, wherein the substance that inhibits photodegradation is selected from hindered amines and hindered phenols.

39. The flexible fabric of claim 21, wherein the ribbon-like, conjugate, spun filaments incorporate a substance that absorbs moisture.

40. The flexible fabric of claim 39, wherein the substance that absorbs moisture is selected from magnesium sulfate, polyacrylate superabsorbents, aluminum oxide, calcium oxide, silicon oxide, barium oxide, cobalt chloride, and polyvinyl alcohol.

41. The flexible fabric of claim 21, wherein the ribbon-like, conjugate, spun filaments incorporate a substance that is odor adsorbing.

42. The flexible fabric of claim 41, wherein the substance that is odor adsorbing is selected from activated carbon and odor adsorbing zeolites.

43. The flexible fabric of claim 21, wherein the ribbon-like, conjugate, spun filaments incorporate a substance that has anti-microbial properties.

44. Ribbon-like, conjugate, spun filaments comprising:

from about 50 to about 99 percent, by weight, of a low-softening point thermoplastic component forming a ribbon-like core; and from about 1 to about 50 percent, by weight, of a high-softening point component forming a sheath that substantially envelops the core;

wherein the filaments have been durably flattened to a width to height ratio of greater than about 2:1.

45. The filaments of claim 44, wherein the conjugate filaments are conjugate, spunbond filaments.

46. The filaments of claim 44 wherein the high-softening point component is selected from polyesters, polyamides and high-softening point polyolefins.

47. The filaments of claim 44, wherein the low-softening point thermoplastic component is selected from low-softening point polyolefins, low-softening point elastomeric block copolymers, and blends of the same.

48. The filaments of claim 44, wherein the sheath includes a distribution of rugosities across at least a portion of the surface of the sheath.

49. The filaments of claim 44, wherein the sheath includes multiple lobes across at least a portion of the surface of the sheath.

50. The flexible fabric of claim 44, wherein the sheath includes multiple lobes and a distribution of rugosities across at least a portion of the surface of the sheath.

51. The filaments of claim 44, wherein the filaments incorporate a substance that reflects ultra-violet wavelength radiation.

52. The filaments of claim 44, wherein the filaments incorporate a substance that absorbs ultra-violet wavelength radiation.

53. The filaments of claim 44, wherein the filaments incorporate a substance that inhibits photodegradation.

54. The filaments of claim 44, wherein the filaments incorporate a substance that absorbs moisture.

55. The filaments of claim 44, wherein the filaments incorporate a substance that is odor adsorbing.

56. The filaments of claim 44, wherein the filaments incorporate a substance that has anti-microbial properties.

* * * * *